United States Patent [19]

Hirai et al.

[11] Patent Number: 4,704,345

[45] Date of Patent: Nov. 3, 1987

[54] HEAT DEVELOPMENT IN PRESENCE OF WATER

[75] Inventors: Hiroyuki Hirai; Hideki Naito, both of Kanagawa, Japan

[73] Assignee: Fuji Photo Film Co., Ltd., Kanagawa, Japan

[21] Appl. No.: 891,027

[22] Filed: Jul. 31, 1986

Related U.S. Application Data

[63] Continuation of Ser. No. 614,924, May 29, 1984, abandoned.

[30] Foreign Application Priority Data

May 26, 1983 [JP] Japan ..... 58-92876

[51] Int. Cl.[4] ..... G03C 5/54

[52] U.S. Cl. ..... 430/203; 430/351

[58] Field of Search ..... 430/203

[56] References Cited

U.S. PATENT DOCUMENTS 4,430,415 2/1984 Aono et al. ..... 430/203

4,473,631 9/1984 Hirai et al. ..... 430/203

FOREIGN PATENT DOCUMENTS 0076492 4/1983 European Pat. Off. ..... 430/203

*Primary Examiner*—Richard L. Schilling

*Attorney, Agent, or Firm*—Sughrue, Mion, Zinn, Macpeak & Seas

[57] ABSTRACT

A method of forming an image comprising heating a light-sensitive material having at least a light-sensitive silver halide, a binder and a dye releasing redox compound which is capable of reducing the light-sensitive silver halide and is capable of reacting with the light-sensitive silver halide by heating to release a hydrophilic diffusible dye on a support after or simultaneously with imagewise exposure in the presence of water and a base and/or a base precursor to form a mobile dye and transferring the mobile dye to a dye fixing layer at the time of heating for development.

In accordance with the method of the present invention, a clear color image having a high density and low fog can be obtained in a short time by a simple procedure.

27 Claims, No Drawings

HEAT DEVELOPMENT IN PRESENCE OF WATER

This is a continuation of application Ser. No. 614,924, filed May 29, 1984, now abandoned.

FIELD OF THE INVENTION

The present invention relates to a novel method of forming a dye image by heating. The present invention also relates to a novel light-sensitive material containing a dye releasing redox compound capable of reacting with a light-sensitive silver halide by heating to release a hydrophilic diffusible dye and a method of forming an image using thereof.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for light-sensitive materials using silver halide, many techniques capable of easily and quickly obtaining images have been developed by changing the conventional wet process using a developing solution into a dry development process such as a process using heat, etc.

Heat-developable light-sensitive materials are known in the field of these techniques. Heat-developable light-sensitive materials and processes therefor have been described, for example, in *Shashin Kogaku no Kiso* (*The Foundation of Photographic Technology*), pages 553 to 555 (published by Corona Co., 1979), *Eizo Jyoho* (*The Image Information*), page 40 (April, 1978), *Nebletts Handbook of Photography and Reprograph,* 7th Ed., pages 32 to 33 (Van Nostrand Reinhold Company), U.S. Pat. Nos. 3,152,904, 3,301,678, 3,392,020 and 3,457,075, British Pat. Nos. 1,131,108, and 1,167,777, and *Research Disclosure,* No. 17029, pages 9 to 15 (June, 1978).

Many different processes for obtaining color images have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonaimidophenol type reducing agent as described in Belgian Pat. No. 802,519 and *Research Disclosure,* pages 31 and 32 (Sept., 1975) and the combination of a sulfonamidophenol type reducing agent and a 4-equivalent coupler as described in U.S. Pat. No. 4,021,240. These processes, however, are disadvantageous in that turbid color images are formed, because a reduced silver image and a color image are silultaneously formed on the exposed area after heat-development. In order to eliminate these disadvantages, there have been proposed a process which comprises removing a silver image by liquid processing or a process which comprises transferring only the dye to another layer, for example, a sheet having an image receiving layer. However, the latter process is not desirable because it is not easy to transfer only the dye as distinguishable from unreacted substances.

Another process which comprises introducing a nitrogen containing heterocyclic group into a dye, forming a silver salt and releasing a dye by heat-development has been described in *Research Disclosure,* No. 16966, pages 54 to 58 (May, 1978). According to this process, clear images cannot be obtained, because it is difficult to control the release of dyes from nonexposed areas, and thus it is not a conventionally applicable process.

Also, processes for forming a positive color image by a light-sensitive silver dye bleach process, with useful dyes and methods for bleaching have been described, for example, in *Research Disclosure,* No. 14433, pages 30 to 32 (April, 1976), ibid., No. 15227, pages 14 and 15 (Dec., 1976) and U.S. Pat. No. 4,235,957.

However, this process requires an additional step and an additional material for accelerating bleaching of dyes, for example, heating with a superposed sheet with an activating agent. Furthermore, it is not desirable because the resulting color images are gradually reduced and bleached by coexisting free silver during long periods of preservation.

Moreover, a process for forming a color image utilizing a leuco dye has been described, for example, in U.S. Pat. Nos. 3,985,565 and 4,022,617. However, this process is not desirable because it is difficult to stably incorporate the leuco dye in the photographic material and coloration gradually occurs during preservation.

Moreover, these methods described above have disadvantages in that a relatively long time is generally required for development and that only images having a high level of fog and a low density are obtained.

In order to eliminate these drawbacks, a method of forming an image has been proposed in which a mobile dye is is imagewise formed utilizing silver halide and the dye is transferred to a dye fixing layer (as described in European Patent Application (OPI) No. 76492). According to the method a light-sensitive material containing silver halide and a dye releasing redox compound which functions to the silver halide as a reducing agent at an elevated temperature and at the same time is oxidized to release a mobile dye is heated under the condition substantially free from water after or simultaneously with exposure to form imagewise a mobile dye and transferring the mobile dye to a dye fixing layer.

In such a image forming method, both a step for forming edgewise mobile dyes by heating and a step for transferring the dyes to a dye fixing layer are indispensable. If these two steps can be carried out at the same time, a more rapid and easy processing is possible. As a result of various investigations from this point of view, it has been found that it is possible by heating at a temperature lower than a boiling point of a solution a light-sensitive material superposed on a dye fixing material under the condition maintaining water in the presence of a base or a base precursor capable of releasing a base by heating. It has also been found that in the so-called mono-sheet type light-sensitive material in which a dye fixing layer is incorporated into a light-sensitive material it is possible when the material is heated under the condition maintaining water by means of close contact with a material hardly permeating moisture such as a polyethylene terephthalate film, etc.

SUMMARY OF THE INVENTION

Therefore, an object of the present invention is to provide a novel process for forming a dye image by heating, eliminating the drawbacks present in known light-sensitive materials.

Another object of the present invention is to provide a method for rapidly obtaining a color image.

Still another object of the present invention is to provide a method for forming a color image having a high density and a low level of fog.

Still another object of the present invention is to provide a method for obtaining a color image by a simple procedure.

These and other objects of the present invention will become more apparent from the following detailed decription and examples.

These objects of the present invention are accomplished with a method of forming an image comprising heating a light-sensitive material having at least a light-sensitive silver halide, a binder and a dye releasing redox compound which is capable of reducing the light-sensitive silver halide and is capable of reacting with the light-sensitive silver halide by heating to release a hydrophilic diffusible dye on a support after or simultaneously with imagewise exposure in the presence of water and a base and/or a base precursor to form a mobile dye and transferring the mobile dye to a dye fixing layer at the time of heating for development.

DETAILED DESCRIPTION OF THE INVENTION

The dye fixing layer which can be used in the present invention may be present either in the light-sensitive material or in a material which is provided apart from the light-sensitive material.

The base and/or base precursor which can be used in the present invention may be incorporated either into the light-sensitive material or into a dye fixing material having the dye fixing layer which is separately provided from the light-sensitive material. Further, the base and/or base precursor may be used under the condition wherein it is dissolved in water used in the present invention.

An amount of water used in the present invention is at least 0.1 time by weight of the total coated layers constituting the light-sensitive material and the dye fixing material, preferably in a range from 0.1 time by weight of the total coated layers to a weight of water corresponding to the maximum swelling volume of the total coated layers, and more preferably in a range from 0.1 time by weight of the total coated layers to an amount which is obtained by deducting a weight of the total coated layers from the weight of water corresponding to the maximum swelling volume of the total layers.

The state of layer which is swelled is unstable and it is feared that the exudation locally occurs under certain conditions. In order to avoid such exudation it is preferred to employ water in an amount not exceeding the weight of water corresponding to the maximum swelling volume of the total coated layers constituting the light-sensitive material and the dye fixing material. However, the same effects are obtained in case of employing water in an amount exceeding the above described upper limit as those which are obtained when a desirable range of water is used except that the above described problems may occur.

The term "transferring the mobile dye to a dye fixing layer at the time of heating for development" means to transfer the mobile dye to the dye fixing layer utilizing effects of heating for development and includes a method in which the development and the transfer of dye are carried out under a condition of high temperature.

In the present invention, the development can be conducted at a pH much lower than that of layer during development of the so-called color diffusion transfer process in which a developing solution is spread in a film unit and development is carried out around normal temperature, since development by heating is utilized and water is present only for transferring of the dye distributed imagewise. To operate development at a high pH is rather disadvantageous because fog increases remarkably. Therefore, it is preferred to use pH of not more than 12, and particularly not more than 11, when the layer is heated for development and transfer of dye.

On the other hand, it is desired to maintain an appropriately high pH such as pH of at least 8 since the development by heating does not proceed at a too much low pH. A pH of 9 or more is particularly preferred.

In the above described range of pH color images having low fog and a high density can be obtained in a short time. The pH value of layer is determined in the following manner. The light-sensitive material is heated in the same manner as development without exposure to light, to the light-sensitive material is dropped 20 $\mu$l of water after the light-sensitive material is cooled to room temperature and a pH electrode is immediately contacted with the light-sensitive material whereby a pH of the layer under equilibrium is measured. When the light-sensitive material and the dye fixing material are separately provided, they must be heated in a superposed form, while in the case wherein the light-sensitive material and the dye fixing material are unified they are heated as they are. After the heating, a pair of the dye fixing material is peeled apart and a pH of the light-sensitive layer is measured in the above described manner.

Any binder which is capable of transferring the hydrophilic dye in the presence of water can be used to form a coated layer. The coated layer used in the present invention may contain a light-sensitive silver halide, a dye releasing redox compound, a mordant, an organic solvent having a high boiling point, or other additives.

The maximum swelling volume can be calculated from multiplying an area of the coated layer to be determined in the light-sensitive material or the dye fixing material by a thickness of the layer which is determined by immersing the light-sensitive material or dye fixing material having the coated layer in water used and measuring a length of a section of the layer which has been sufficiently swelled by means of a microscope, etc. A method of measuring the swelling degree is described in Photographic Science and Engineering, Vol. 16, page 449 (1972).

The swelling degree of a gelatin layer can be widely varied depending on a degree of hardening. In general, however, the degree of hardening is so regulated that a thickness of the layer at the maximum swelling is between 2 times and 6 times of a dry thickness of the layer.

In the photographic light-sensitive material of the present invention, the photographic emulsion layer and other hydrophilic colloid layers may contain inorganic or organic hardeners. Examples of usable hardeners include chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

The above described water can be supplied to the dye fixing material, the light-sensitive material or both of them. In the present invention, water can be supplied in any manner. For instance, it can be done by means of a jet from a small nozzle or a wet web roller. Further, a method in which a pod containing water is crushed can be used. A process for supplying water is not limited to these methods. Moreover, water can be incorporated into the material in the form of water of crystallization or microcapsules.

The water which can be used in the present invention is not limited to the so-called distilled water but includes water the term of which is customarily employed. Further, it can be an aqueous solution containing a base and/or a baser precursor as described below or a mixture of water and a solvent having a low boiling point such as methanol, dimethylformamide, acetone, diisobutyl ketone, etc. Moreover, an aqueous solution containing a dye releasing activator, an accelerator, a hydrophilic thermal solvent, etc. as described below.

Examples of the base which can be used include an inorganic base, for example, a hydroxide, carbonate, bicarbonate, borate, secondary or tertiary phosphate, quinolinate or metaborate of an alkali metal, alkaline earth metal or quarternary alkyl ammonium; and an organic base, for example, an aliphatic amine, an aromatic amine, a heterocyclic amine, an amidine, a cyclic amidine, a guanidine, a cyclic guanidine, etc., and a carbonate, bicarbonate, borate or secondary or tertiary phosphate thereof, etc.

Examples of the base precursor which can be used include a precursor of the above described organic bases. The term "base precursor" used herein means a substance which releases a basic component by heat-decomposition. Specific examples thereof include a salt of the above described organic base with a heat-decomposable organic acid such as trichloroacetic acid, cyanoacetic acid, acetoacetic acid, α-sulfonylacetic acid, etc., a salt of a base with 2-carboxycarboxamide as described in U.S. Pat. No. 4,088,496, etc. In addition, the base precursors as described in British Pat. No. 998,945, U.S. Pat. No. 3,220,846, Japanese Patent Application (OPI) No. 22625/75, etc. can also be used.

Specific examples of the preferred compounds are set forth below, but the present invention should not be construed as being limited thereto.

Lithium hydroxide, sodium hydroxide, barium hydroxide, sodium carbonate, cesium carbonate, sodium hydrogen carbonate, potassium carbonate, potassium hydrogen carbonate, sodium quinolinate, sodium secondary phosphate, potassium secondary phosphate, sodium tertiary phosphate, potassium tertiary phosphate, sodium pyrophosphate, potassium pyrophosphate, sodium metaborate, borax, aqueous ammonia, tetramethyl ammonium hydroxide, tetraethyl ammonium hydroxide, $(CH_3)_2NH$, $(C_2H_5)_2NH$, $C_3H_7NH_2$, $HOC_2H_4NH_2$, $(HOC_2H_4)_2NH$, $(HOC_2H_4)_3N$, $H_2NC_2H_4NH_2$, $H_2NC_4H_8NH_2$, $CH_3NHC_2H_4NHCH_3$, $(CH_3)_2NC_3H_6N(CH_3)_2$,

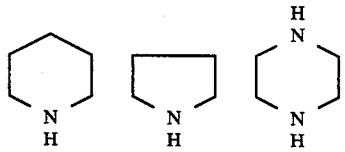

-continued

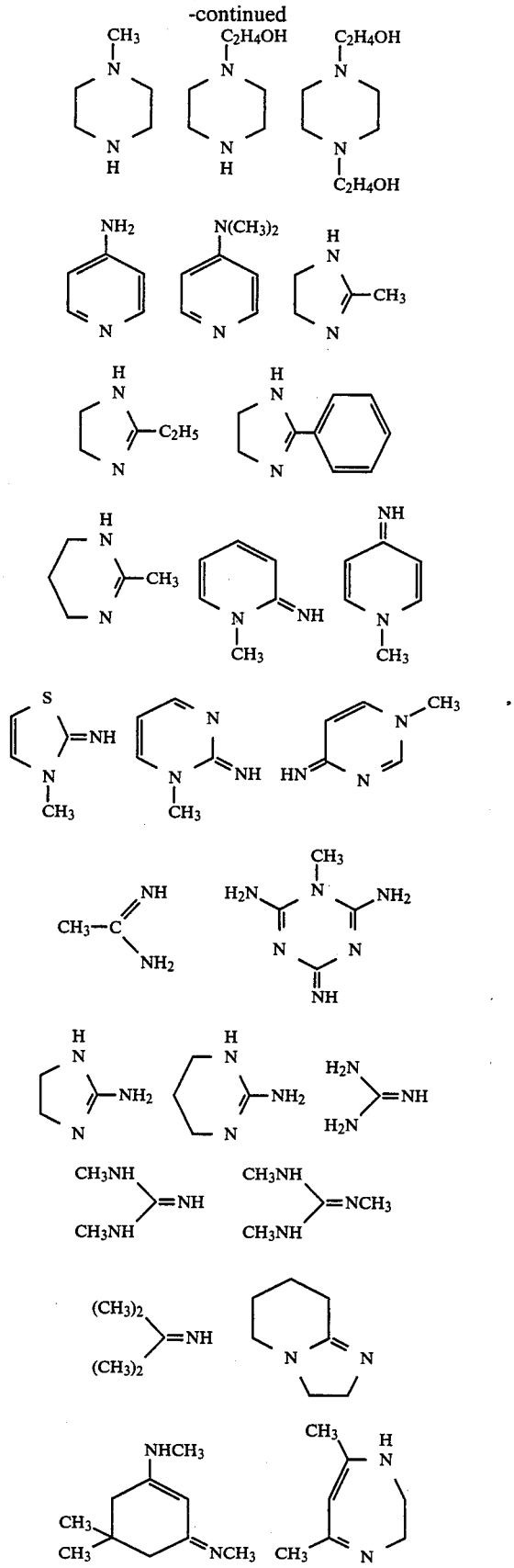

guanidine trichloroacetic acid, piperidine trichloroacetic acid, morpholine trichloroacetic acid, p-toluidine trichloroacetic acid, 2-picoline trichloroacetic acid, guanidine carbonate, piperidine carbonate, morpholine carbonate, tetramethyl ammonium trichloroacetic acid, etc.

The bases and/or base precursors can be employed individually or as a mixture of two or more thereof.

The base and/or base precursor according to the present invention can be used in an amount of a broad range. It is suitable to use in an amount of 50% by weight or less, and more preferably in a range from 0.01% by weight to 40% by weight, based on the weight of the coated layer, when it is used in the light-sensitive layer and/or dye fixing layer. On the other hand, when it is used by dissolving it in water according to the present invention, it is preferred to use in a range from 0.005 mole/l to 2 moles/l and particularly, from 0.05 mole/l to 1 mole/l. The amount added does not directly relate to pH, because the base and/or base precursor may move to other layers in some cases when superposed on the dye fixing material, etc.

Since the light-sensitive material contains relatively large amount of water as a solvent in the present invention, the maximum temperature of the light-sensitive material when heated is decided upon a boiling point of an aqueous solution (i.e., water added in which various kinds of additives are dissolved) present in the light-sensitive material. The heating is preferably conducted at a temperature of 50° C. or more. Because the boiling point of water is 100° C. at normal pressure, the water is lost by evaporation in case of heating at 100° C. or more. It is preferred, therefore to cover the surface of the light-sensitive material with a water-impermeable material or to supply aqueous vapor at high temperature and high pressure. In these cases, it is advantageous that the temperature of the light-sensitive material is increased due to the rise of the boiling point of aqueous solution.

As the heating means, a simple heat plate, iron, heat roller, heat generator utilizing carbon or titanium white, etc., or analogous thereof may be used.

The term "dye image" used in the present invention means a multicolor or monocolor dye image. The monocolor dye image includes a monocolor dye image composed of a mixture of two or more dyes.

The method of forming a dye image according to the present invention can transfer simultaneously with development a mobile dye which is formed on the part corresponding to the silver image to a dye fixing layer by heating after or simultaneous with imagewise exposure to light in the presence of a small amount of water. That is, in the method of forming a dye image according to the present invention, when the light-sensitive material is imagewise exposed to light and developed by heating in the presence of water, an oxidation-reduction reaction occurs between an exposed light-sensitive silver halide and a reducing dye releasing redox compound to form a silver image in the exposed area in case of using a negative type silver halide emulsion. In this step, the dye releasing redox compound is oxidized by the silver halide to form an oxidized compound and consequently the hydrophilic mobile dye is released. Accordingly, the silver image and the mobile dye are formed in the exposed area. The above-described reaction is accelerated when a dye releasing activator is present. The mobile dye thus formed is immediately transferred to a dye fixing layer because of the presence of water whereby a dye image is obtained in a short time. In a case wherein an autopositive type silver halide emulsion is used, the process is the same as the case of using the negative type silver halide emulsion except that a silver image and a mobile dye are formed in the unexposed area.

The dye releasing redox compound which releases a hydrophilic diffusible dye used in the present invention is a compound described in European Patent Application (OPI) No. 76,492 as a dye releasing compound and is represented by the following general formula:

$$R_a\text{-}SO_2\text{-}D$$

wherein $R_a$ represents a reducing group capable of being oxidized by the silver halide; and D represents an image forming dye portion containing a hydrophilic group.

The above-described compound is oxidized corresponding to or reversely corresponding to latent image distributed imagewise in the silver halide and releases imagewise a mobile dye.

The detail definitions of $R_a$ and D, examples of the specific compounds and synthesis examples thereof are described in European Patent Application (OPI) No. 76,492.

As the dye releasing redox compounds used in the present invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published Patent Application B 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120, etc., are also effective in addition to the above-described compounds.

Further, the dye releasing redox compounds which release a yellow dye as described, for example, in U.S. Pat. Nos. 4,013,633, 4,156,609, 4,148,641, 4,165,987, 4,148,643, 4,183,755, 4,246,414, 4,268,625 and 4,245,023, Japanese Patent Application (OPI) Nos. 71072/81, 25737/81, 138744/80, 134849/80, 106727/77, 114930/76, etc., can be effectively used in the present invention.

The dye releasing redox compounds which release a magenta dye as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in the present invention.

The dye releasing redox compounds which release a cyan dye as described, for example, in U.S. Pat. Nos. 3,929,760, 4,013,635, 3,942,987, 4,273,708, 4,148,642, 4,133,754, 4,147,544, 4,165,238, 4,246,414 and 4,268,625, Japanese Patent Application (OPI) Nos. 71061/81, 47823/78, 8827/77 and 143323/78, etc., can be effectively used in the present invention.

Two or more of the dye releasing redox compounds can be used together. In these cases, two or more dye releasing redox compounds may be used together in order to represent the same color or in order to represent black color.

The dye releasing redox compounds are suitably used in a range from 10 mg/m$^2$ to 15 g/m$^2$ and preferably in a range from 20 mg/m$^2$ to 10 g/m$^2$ in a total.

The dye releasing redox compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, 3-ethoxyethyl acetate, methyl cellosolve acetate, cyclohexanone, etc. The above-described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

In the present invention, if necessary, a reducing agent may be used. The reducing agent in this case is the so-called auxiliary developing agent, which is oxidized by the silver halide and/or the organic silver salt oxidizing agent to form its oxidized product having an ability to oxidize the reducing group $R_a$ in the dye releasing redox compound.

Examples of useful auxiliary developing agents include the compounds specifically described in European Patent Application (OPI) No. 76,492.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its grain. That is, the silver halide which shows the X-ray diffraction pattern of pure silver iodide is particularly preferred.

In photographic materials a silver halide containing two or more kinds of halogen atoms can be used. Such a silver halide is present in the form of a completely mixed crystal in a conventional silver halide emulsion. For example, the grain of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its grain and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds or sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above-described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessarily to have the characteristic in that the silver halide contains pure silver iodide crystal in the case of using the silver halide alone. Any silver halide which is known in the art can be used.

Examples of such organic silver salt oxidizing agents include those described in European Patent Application (OPI) No. 76,492.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. Nos. 3,700,453, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, etc., a cellulose derivative, a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, can be contained in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

As nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used in merocyanine dyes and complex merocyanine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,989, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material or used as the dye fixing material, if desired, according to the present invention is that which can endure at the processing temperature. As an ordinary support, not only glass, paper, metal or analogues thereto may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

It is advantageous to use a compound represented by the general formula described below in the heat-developable color photographic material in order to accelerate development and accelerate release of a dye.

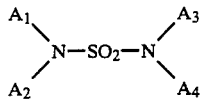

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

The above-described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the present invention, it is possible to use a compound which activates development and stabilizes the image at the same time. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)-methylene-bis(sulfonylacetate, 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, it is possible to use a thermal solvent. The term "thermal solvent" means a non-hydrolyzable organic material which melts at a temperature of heat treatment and melts at a lower temperature of heat treatment when it is present together with other components. Preferred examples of thermal solvents include compounds which can act as a solvent for the developing agent and compounds having a high dielectric constant which accelerate physical development of silver salts. Examples of preferred thermal solvents include those described in European Patent Application (OPI) No. 76,492.

In the present invention, though it is not always necessary to further incorporate substances or dyes for preventing irradiation or halation in the light-sensitive material, because the light-sensitive material is colored by the dye releasing redox compound, it is possible to add filter dyes or light absorbing materials, etc., into the light-sensitive material, as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

The photographic emulsion layer and other hydrophilic colloid layers in the light-sensitive material of the present invention may contain various surface active agents for various purposes, for example, as coating aids, or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate salts, alkylbenzenesulfonate salts, alkylnaphthalenesulfonate salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series*, Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agents, etc.

If necessary, two or more layers may be coated at the same time by the method as described in U.S. Pat. No. 2,761,791 and British Pat. No. 837,095.

Various means for exposure can be used in the present invention. Latent images are obtained by imagewise exposure by radiant rays including visible rays. Generally, light sources used in this invention include tungsten lamps, mercury lamps, halogen lamps such as iodine lamps, xenon lamps, laser light sources, CRT light sources, fluorescent tubes and light-emitting diodes, etc.

In the present invention, a specific method for forming a color image by heat development comprises transfer of a hydrophilic mobile dye. For this purpose, the light-sensitive material of the present invention is composed of a support having thereon a light-sensitive layer (I) containing at least silver halide, optionally an organic silver salt oxidizing agent, a dye releasing redox compound which is also a reducing agent, and a binder, and a dye fixing layer (II) capable of receiving the hydrophilic diffusible dye formed in the light-sensitive layer (I).

The above described light-sensitive layer (I) and the dye fixing layer (II) may be formed on the same support, or they may be formed on different supports, respectively. The dye fixing layer (II) can be stripped off the light-sensitive layer (I). For example, after the light-sensitive material is exposed imagewise to light, it is developed by heating uniformly and thereafter the dye fixing layer (II) or the light-sensitive layer (I) is peeled apart. Also, when a light-sensitive material having the light-sensitive layer (I) coated on a support and a fixing material having the dye fixing layer (II) coated on a support are separately formed, after the light-sensitive material is exposed imagewise to light and uniformly heated in the presence of water, the mobile dye can be transferred on the dye fixing layer (II) by superposing the fixing material on the light-sensitive material.

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer (II) are formed on different supports.

Preferred polymer mordants used in the present invention can be polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming cobalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc., can be illustrated.

In addition, mordants disclosed in U.S. Pat. Nos. 2,675,316 and 2,882,156 can be used.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which can be observed through the transparent support is obtained.

Typical dye fixing material used in the present invention is obtained by mixing the polymer containing ammonium salt groups with gelatin and applying the mixture to a transparent support.

A hydrophilic thermal solvent can be used in the present invention. The hydrophilic thermal solvent is preferably a compound which is solid at ambient temperature and melts by heating. The hydrophilic thermal solvent can be used by being incorporated into the light-sensitive material and/or the dye fixing material or being contained in water according to the present invention. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

The present invention will be explained in greater detail with reference to the following examples, but the present invention should not be construed as being limited thereto.

EXAMPLE 1

In the following, a method of preparing a silver iodobromide emulsion is described.

40 g of gelatin and 26 g of potassium bromide were dissolved in 3,000 ml of water and the solution was stirred while maintaining the temperature at 50° C. A solution containing 34 g of silver nitrate dissolved in 200 ml of water was added to the above described solution over a period of 10 minutes. Then, a solution containing 3.3 g of potassium iodide dissolved in 100 ml of water was added for a period of 2 minutes. By controlling the pH of the silver iodobromide emulsion thus prepared precipitate was formed and the excess salts were removed. The pH of the emulsion was then adjusted to 6.0 and 400 g of the silver iodobromide emulsion was obtained.

In the following, a method of preparing a silver benzotriazole emulsion is described.

28 g of gelatin and 13.2 g of benzotriazole were dissolved in 3,000 ml of water and the solution was stirred while maintaining at 40° C. A solution containing 17 g of silver nitrate dissolved in 100 ml of water was added to the above described solution for a period of 2 minutes. By controlling a pH of the silver benzotriazole emulsion thus prepared to precipitate and the excess salts were removed. The pH of the emulsion was then adjusted to 6.0 and 400 g of the silver benzotriazole emulsion was obtained.

In the following, a method of preparing a gelatin dispersion of a dye releasing redox compound.

A mixture of 5 g of the magenta dye releasing redox compound described below, 0.5 g of sodium 2-ethylhexyl sulfosuccinate, 5 g of tricresyl phosphate (TCP) and 30 ml of ethyl acetate was heated at about 60° C. to form an uniform solution. The solution was mixed with 100 g of a 10% aqueous solution of lime-processed gelatin with stirring and then dispersed using a homogenizer at 10,000 rpm for 10 minutes. The dispersion thus prepared is designated a dispersion of dye releasing redox compound.

MAGENTA DYE RELEASING REDOX COMPOUND

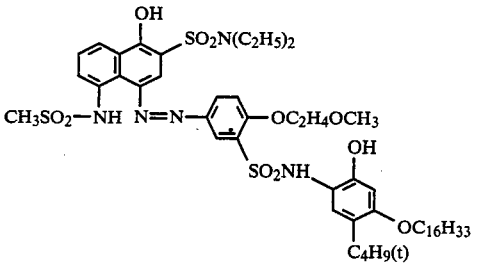

In the following, a method of preparing Light-Sensitive Materials A and B is described.

Light-Sensitive Material A (a) The silver iodobromide emulsion described above: 25 g, (b) The dispersion of dye releasing redox compound described above: 33 g, (c) A 5% aqueous solution of a compound having the following structure:

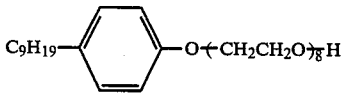

10 ml, (d) A 10% ethanol solution of dimethylsulfamide: 4 ml, (e) Water: 15 ml.

The above-described components (a) to (e) were mixed and dissolved. The solution was coated on a polyethylene terephthalate film at a wet thickness of 30 μm and dried. On the layer thus formed was coated as a protective layer the following composition at a wet thickness of 25 μm and dried.

Coating Composition for Protective Layer (a) A 10% aqueous solution of gelatin: 35 g, (b) A 1% aqueous solution of sodium 2-ethylhexyl sulfosuccinate: 4 ml, (c) Water: 61 ml.

Light-Sensitive Material B (a) The silver benzotriazole emulsion: 10 g, (b) The silver iodobromide emulsion: 20 g, (c) The dispersion of dye releasing redox compound: 33 g, (d) A 5% aqueous solution of a compound having the following structure:

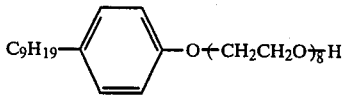

10 ml, (e) A 10% ethanol solution of dimethylsulfamide: 4 ml, (f) Water: 17 ml.

The above-described components (a) to (f) were mixed and dissolved. The solution was coated on a polyethylene terephthalate film at a wet thickness of 30 μm and dried. On this layer a protective layer having the same composition as in Light-Sensitive Material A was coated at a wet thickness of 25 μm and dried.

In the following, a method of preparing a dye fixing material is described.

10 g of copolymer of methyl acrylate and N,N,N-trimethyl-N-vinylbenzyl ammonium chloride (a ratio of methyl acrylate and vinylbenzyl ammonium chloride being 1:1) was dissolved in 200 ml of a 1.5% aqueous solution of sodium carbonate and the solution was uniformly mixed with 100 g of a 10% aqueous solution of lime-processed gelatin. The mixture solution was uniformly coated on a paper support laminated with polyethylene containing titanium dioxide dispersed at a wet thickness of 90 μm and dried. This is used as a dye fixing material having a mordant layer.

Light-Sensitive Materials A and B described above were exposed imagewise at 2,000 lux for 10 seconds using a tungsten lamp. After the dye fixing material described above being supplied with water in an amount of 80 ml per $m^2$ on its surface layer, each of Light-Sensitive Materials A and B was superposed on the dye fixing material so as to bring into contact with each of the surface layers and they were uniformly heated on a heat block heated at 95° C. for 30 seconds. The dye fixing materials were peeled apart from the light-sensitive materials thereby negative magenta color images were obtained on the dye fixing materials. However, these magenta dye images had severe color spread and thus were not clear color images.

The same procedure as described above was repeated except supplying 15 ml per $m^2$ of water on a surface layer of the dye fixing material. In this case, clear magenta color images without color spread were obtained (maximum density: 1.52, minimum density: 0.18). Further, the same procedure as described above was conducted with the light-sensitive material which had not been subjected to light exposure and after the dye fixing material being peeled apart, 20 μl of water was dropped from a micropipet on the surface of the light-sensitive material and a composite pH electrode (manufactured by Horiba Seisakusho) was contacted with water whereby a pH of the layer under equilibrium was measured. The pH was 9.8. The weight of coated layers of Light-Sensitive Materials A and B and the dye fixing material were about 4 g/$m^2$, 4 g/$m^2$ and 5 g/$m^2$ respectively. Also, the maximum swelling layer thickness in the water used were 12 μm, 12 μm and 14 μm respectively. Therefore, a range of preferred amount of water in the above described system was from 0.9 ml/$m^2$ to 26 ml/$m^2$.

EXAMPLE 2

Light-Sensitive Material B prepared in Example 1 was exposed to light and heated in the same manner as described in Example 1. On the surface layer of the dye fixing material, water was supplied in an amount as shown in Table 1 below. The above described light-sensitive materials were superposed on the dye fixing materials thus-supplied with water so as to bring into contact with each of the surface layers, they were heated on a heat block at 95° C. for 30 seconds and then the dye fixing materials were peeled apart from the light-sensitive materials. The maximum densities of the magenta color images obtained on the dye fixing materials were measured using a Macbeth reflective densitometer (RD-519) and the results shown in Table 1 below were obtained.

The pH of a layer of the light-sensitive material which had been supplied with 9.3 ml of water was measured in the same manner as described in Example 1 and was found 9.9.

TABLE 1

| Amount of Water ($ml/m^2$) | Maximum Density | Minimum Density | Remarks |
|---|---|---|---|
| 0.5 | 0.20 | 0.08 | Comparison |
| 1.2 | 0.92 | 0.15 | Present Invention |
| 2.7 | 1.47 | 0.18 | Present Invention |
| 4.4 | 1.79 | 0.26 | Present Invention |
| 9.3 | 1.90 | 0.29 | Present Invention |
| 20.5 | 2.02 | 0.30 | Present Invention |
| 31.0 | 1.95* | 0.28* | Comparison |

*color spread was observed

From the results of pH shown in Examples 1 and 2 above, it is apparent that the samples according to the present invention provide color images having a sufficiently high image density and low fog in spite of low pH value.

EXAMPLE 3

Using a sample supplied with 2.7 ml of water in Example 2, heating time on a heat block was changed. As the results, the maximum density of 1.80 was obtained by heating for 40 seconds. Also, with respect to a sample supplied with 1.2 ml of water, the maximum density of 1.48 was obtained by heating for 60 seconds. From these results, it becomes apparent that clear color images free from color spread can be obtained by extending heating time in the cases wherein the amount of water supplied is low.

EXAMPLE 4

A light-sensitive material was prepared in the same manner as described for Light-Sensitive Material B in Example 1 except that a weight of the protective layer was changed to 14 $g/m^2$ (the maximum swelling layer thickness of the protective layer was 40 $\mu m$). Using the light-sensitive material thus-prepared, the same procedure and processing as described in Example 2 were carried out. As the results, it was found that a sufficiently high color image density was obtained in samples wherein 2.7 ml or more of water was supplied and that a clear color image free from color spread was obtained even in a sample wherein 31.0 ml of water was supplied.

EXAMPLE 5

Using a dye fixing containing an aqueous solution of a base or base precursor as described in Table 2 below in place of the 1.5% aqueous solution of sodium carbonate used in the dye fixing material of Example 1, the same procedure as described in Example 1 was repeated. In this case, Light-Sensitive Material B was used and the amount of water supplied was 15 $ml/m^2$. Also, a pH value of the light-sensitive material at processing was measured in the same manner as described in Example 1. The results thus-obtained are shown in Table 2 below.

TABLE 2

| Base or Base Precursor | Maximum Density | Minimum Density | pH |
|---|---|---|---|
| Sodium Carbonate (1.0% aq. soln.) | 1.55 | 0.22 | 9.9 |
| Potassium Hydrogen Carbonate (1.5% aq. soln.) | 1.43 | 0.22 | 9.8 |
| Cesium Carbonate (4.0% aq. soln.) | 1.97 | 0.27 | 9.9 |
| Guanidine Carbonate (2.5% aq. soln.) | 2.05 | 0.29 | 10.1 |
| $(CH_3)_2C{=}NH.CCl_3CO_2H$ $(CH_3)_2$ (4.0% aq. soln.) | 1.88 | 0.25 | 10.1 |
| 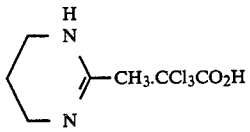 (3.5% aq. soln.) | 1.69 | 0.23 | 9.9 |
| $(CH_3)_4\overset{\oplus}{N}.CCl_3CO_2^{\ominus}$ (1.5% aq. soln.) | 2.03 | 0.27 | 10.0 |

The color images thus-obtained were free from color spread and clear. In any sample, a sufficiently high image density as well as low fog was obtained although the pH was around 10.

EXAMPLE 6

A dye fixing material was prepared in the same manner as described in Example 1 except using water in place of the 1.5% aqueous solution of sodium carbonate. A 0.5M aqueous solution of sodium carbonate was supplied in an amount of 15 $ml/m^2$ on a surface layer of the dye fixing material, on which Light-Sensitive Material B as described in Example 1 was superposed so as to bring into contact with each of the surface layers and they were uniformly heated on a heat block heated at 95° C. for 30 seconds. The dye fixing material was then peeled apart from the light-sensitive material whereby a clear negative magenta color image was obtained on the dye fixing material.

While the invention has been described in detail and with reference to specific embodiment thereof, it will be apparent to one skilled in the art that various changes and modifications can be made therein without departing from the spirit and scope thereof.

What is claimed is:

1. A method of forming an image comprising heating a light-sensitive material having at least a light-sensitive silver halide, a binder and a dye releasing redox compound which is capable of reducing the light-sensitive silver halide and is capable of reacting with the light-sensitive silver halide by heating at a temperature of from 50° C. to the boiling point of water to release a hydrophilic diffusible dye on a support after or simultaneously with imagewise exposure in the presence of water and a base and/or a base precursor to form a mobile dye and transferring the mobile dye to a dye fixing layer at the time of heating for development, wherein an amount of the water is in a range from 0.1 time by weight of the total coated layers included in the material relevant to the image forming method to a weight of water corresponding to the maximum swelling volume of the total coated layers, and the water is supplied to the light-sensitive material or the water is supplied to the dye fixing material.

2. A method of forming an image as claimed in claim 1, wherein the dye fixing layer is provided in the light-sensitive material.

3. A method of forming an image as claimed in claim 1, wherein the dye fixing layer is provided in a dye fixing material.

4. A method of forming an image as claimed in claim 1, wherein the base and/or base precursor is present in the dye fixing layer.

5. A method of forming an image as claimed in claim 1, wherein the base and/or base precursor is present in the water.

6. A method of forming an image as claimed in claim 5, wherein an amount of the base and/or base precursor is from 0.005 mol/l to 2 mol/l.

7. A method of forming an image as claimed in claim 1, wherein a pH of the layer at the time of heating is in a range from 8 to 12.

8. A method of forming an image as claimed in claim 7, wherein a pH of the layer is in a range from 9 to 11.

9. A method of forming an image as claimed in claim 1, wherein the binder is gelatin.

10. A method of forming an image as claimed in claim 1, wherein the light-sensitive material further contains an organic silver salt oxidizing agent.

11. A method of forming an image as claimed in claim 1, wherein the dye fixing layer contains a mordant for fixing the mobile dye.

12. A method of forming an image as claimed in claim 1, wherein the water is pure water.

13. A method of forming an image as claimed in claim 1, wherein the water is an aqueous solution containing the base and/or base precursor.

14. A method of forming an image as claimed in claim 1, wherein the water is a mixture of water and an organic solvent having a low boiling point.

15. A method of forming an image as claimed in claim 1, wherein the water is an aqueous solution containing a dye releasing activator, an accelerator or a hydrophilic thermal solvent.

16. A method of forming an image as claimed in claim 1, wherein the base is an inorganic base or an organic base.

17. A method of forming an image as claimed in claim 1, wherein the base precursor is a substance which releases a basic component by heat-decomposition.

18. A method of forming an image as claimed in claim 1, wherein an amount of the base and/or base precursor is 50% by weight or less based on the weight of the layer to be incorporated.

19. A method of forming an image as claimed in claim 1, wherein the heating is carried out in the presence of a hydrophilic thermal solvent.

20. A method of forming an image as claimed in claim 19, wherein the hydrophilic thermal solvent is present in the light-sensitive material.

21. A method of forming an image as claimed in claim 19, wherein the hydrophilic thermal solvent is present in the dye fixing layer and/or adjacent layers thereto.

22. A method of forming an image as claimed in claim 1, wherein the light-sensitive material comprises a support having thereon a light-sensitive layer containing the light-sensitive silver halide, the binder and the dye releasing redox compound.

23. A method of forming an image as claimed in claim 22, wherein the light-sensitive layer further contains an organic silver salt oxidizing agent.

24. A method of forming an image as claimed in claim 1, wherein the light-sensitive material is exposed imagewise, superposed on the dye fixing layer and subjected to the heating to transfer the mobile dye to the dye fixing layer.

25. A method of forming an image as claimed in claim 24, wherein the dye fixing layer is peeled apart from the light-sensitive material after the heating.

26. A method of forming an image as claimed in claim 24, wherein the dye fixing layer contains the base and/or base precursor.

27. A method of forming an image as claimed in claim 26, wherein the dye fixing layer further contains the water.

* * * * *